US005992766A

United States Patent [19]

Hofmann

[11] Patent Number: 5,992,766

[45] Date of Patent: Nov. 30, 1999

[54] FUEL INJECTION VALVE

[75] Inventor: Karl Hofmann, Remseck, Germany

[73] Assignee: Robert Bosch GmbH, Stuttgart, Germany

[21] Appl. No.: 09/114,277

[22] Filed: Jul. 13, 1998

[30] Foreign Application Priority Data

Jul. 11, 1997 [DE] Germany ..... 197 29 827

[51] Int. Cl.[6] ..... F02M 59/00

[52] U.S. Cl. ..... 239/533.2

[58] Field of Search ..... 239/533.2, 533.3, 239/533.8, 533.12

*Primary Examiner*—Andres Kashnikow
*Assistant Examiner*—Davis Hwu
*Attorney, Agent, or Firm*—Edwin E. Greigg; Ronald E. Greigg

[57] ABSTRACT

A fuel injection valve for internal combustion engines, including a valve member, which is displaceable in a valve body counter to a restoring force of a valve spring and has a valve sealing face, which cooperates with a valve seat disposed on the valve body. The fuel injection valve has a plurality of injection ports, disposed below the valve seat in the valve body, whose inlet openings are curved rounded, it is provided that some of the injection ports have at least one degree of curved roundness that is different from the remainder of the injection ports.

6 Claims, 2 Drawing Sheets

FUEL INJECTION VALVE

BACKGROUND OF THE INVENTION

The invention relates to a fuel injection valve for internal combustion engines, including a valve member, which is displaceable in a valve body counter to the restoring force of a valve spring and has a valve sealing face, which cooperates with a valve seat disposed on the valve body, and having a plurality of injection ports, disposed below the valve seat in the valve body, whose inlet openings are rounded.

One such fuel injection valve for an internal combustion engine is disclosed for instance in European Patent Disclosure EP 0 370 659 A1. The roundness of the inlet openings of the injection ports makes it possible for a larger quantity of fuel to be injected through the injection ports into the combustion chamber of the engine, because no constriction of the fuel flowing through the injection ports occurs as would result if the inlet opening had a sharp edge.

Also as a result of the rounded curved inlet openings, the shape of the stream ejected through the injection ports can be varied. In the fuel injection valve known from EP 0 370 659 A1, it is provided in this respect that the injection ports, on their side toward the valve member, have a different degree of roundness than on their side remote from the valve member.

Here and below, the term degree of roundness is understood to mean the radius of the rounded curved feature. A high degree of roundness means a rounded feature with a large radius, and a low degree of roundness means a rounded feature with a small radius.

The degrees of roundness of the inlet opening of the injection port of the fuel injection valve disclosed by EP 0 370 659 A1 are selected such that the most optimal possible combustion in the combustion chamber can be attained.

If—as is usual today—a plurality of injection ports are provided in the fuel injection valve, then fixed, predetermined injection ports and the resultant shapes of the stream of ejected fuel may not be very advantageous, depending on the installation position in the combustion chamber of an internal combustion engine.

OBJECT AND SUMMARY OF THE INVENTION

It is therefore an object of the invention to refine a fuel injection valve of the generic type defined at the outset such that in a way that is simple to produce, it becomes possible to adapt the injection ports to the most various conditions, and in particular to the most various installed positions in combustion chambers and the most various shapes of combustion chambers, so that the combustion process is further improved.

This object is attained according to the invention, in a fuel injection valve of the type described at the outset, in that some of the injection ports have at least one degree of curved roundness that is different from the remainder of the injection ports.

Because at least some of the injection ports have a degree of curved roundness differing from that of the remainder of the injection ports, it becomes possible in particular for the shapes of the streams flowing out of the individual injection ports of a fuel injection valve to be adapted to the particular installation situation and installed position. In particular, this makes it possible by means of a single fuel injection valve to produce a plurality of stream shapes differing from one another, thus achieving a position-dependent distribution of the quantity of fuel injected into a combustion chamber.

A plurality of injection ports may have the same degree of curved roundness, but it is also possible for all the injection ports to have inlet openings with completely different degrees of curved roundness. Purely in principle, the most various combinations are conceivable with regard to the degrees of curved roundness of the individual injection ports.

One advantageous embodiment provides that the inlet openings of individual injection ports or a plurality of injection ports have a different degree of curved roundness, on their side toward the valve member, than on their side remote from the valve member. In this case, the degree of curved roundness not only varies from one injection port to the next but also as a function of the position of the inlet openings relative to the valve member at each inlet opening of the individual injection ports.

It is preferably provided that the degree of curved roundness of the injection ports is adapted to the disposition of the injection ports in the valve body, to the installation position in a combustion chamber of the engine, and to the shape of the combustion chamber of the engine.

It proves to be advantageous that the degree of curved roundness of the inlet opening of the injection port which in the installed state is farther away from a combustion chamber wall, has a higher degree of curved roundness than the inlet opening of an injection port that is not as far away from the combustion chamber wall. Because of the greater degree of curved roundness, tighter focusing and a greater length of the fuel stream ejected through such an injection port is thus attained than in the case of an injection port that has an inlet opening with a lower degree of curved roundness.

In another advantageous embodiment, it is provided that one or more of the injection ports have no curved rounded feature.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 2:
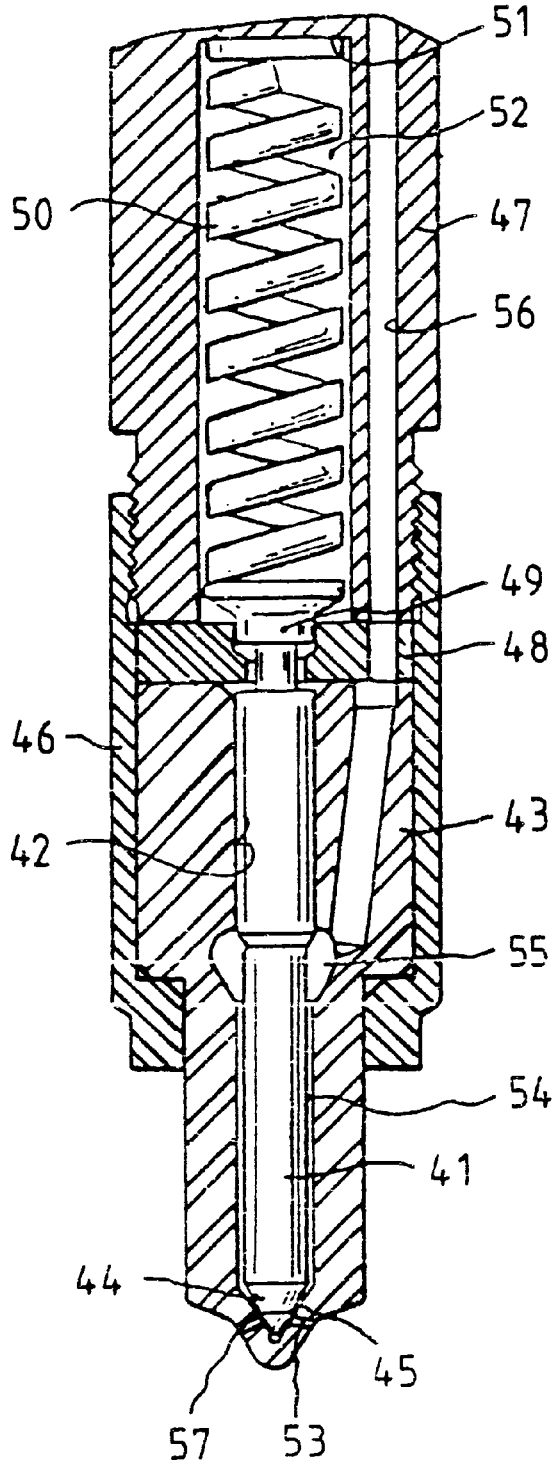
FIG. 2 is a sectional view of a fuel injection valve.

A fuel injection valve for internal combustion engines, shown in FIG. 2, includes a pistonlike valve member 41, which is guided axially displaceably in a bore 42 of a valve body 43. On one end, oriented toward the combustion chamber of an internal combustion engine (not shown), the valve member 41 has a conical valve sealing face 44, with which it cooperates with a conical valve seat 45 on the inward-protruding, closed end of the bore 42. The valve body 43 is braced axially by its end remote from the combustion chamber against a valve retaining body 47, by means of a lock nut 46; a shim 48 with a central opening is fastened between the end faces of the valve body 43 and of the valve retaining body 47.

On its end remote from the valve seat 45, the valve member 41 is acted upon, via a pressure-piece 49 that protrudes through the shim 48, by a spring force of a valve spring embodied as a helical spring 50, which is braced on a stationary stop 51 disposed on the valve retaining body 47 and which exerts a force, oriented toward the valve seat 45, on the valve member 41.

Below the valve sealing face 44 and the valve seat 45, injection ports 53, 57 are provided in the wall of the valve body 43; they discharge into the combustion chamber of the engine.

The high-pressure fuel delivery is effected in a known way via an annular conduit 54, embodied between the shaft of the valve member 41 and the wall of the bore 42; this conduit widens into a pressure chamber 55, into which a pressure line 56, leading away from an injection pump not shown, discharges.

Figure 1:
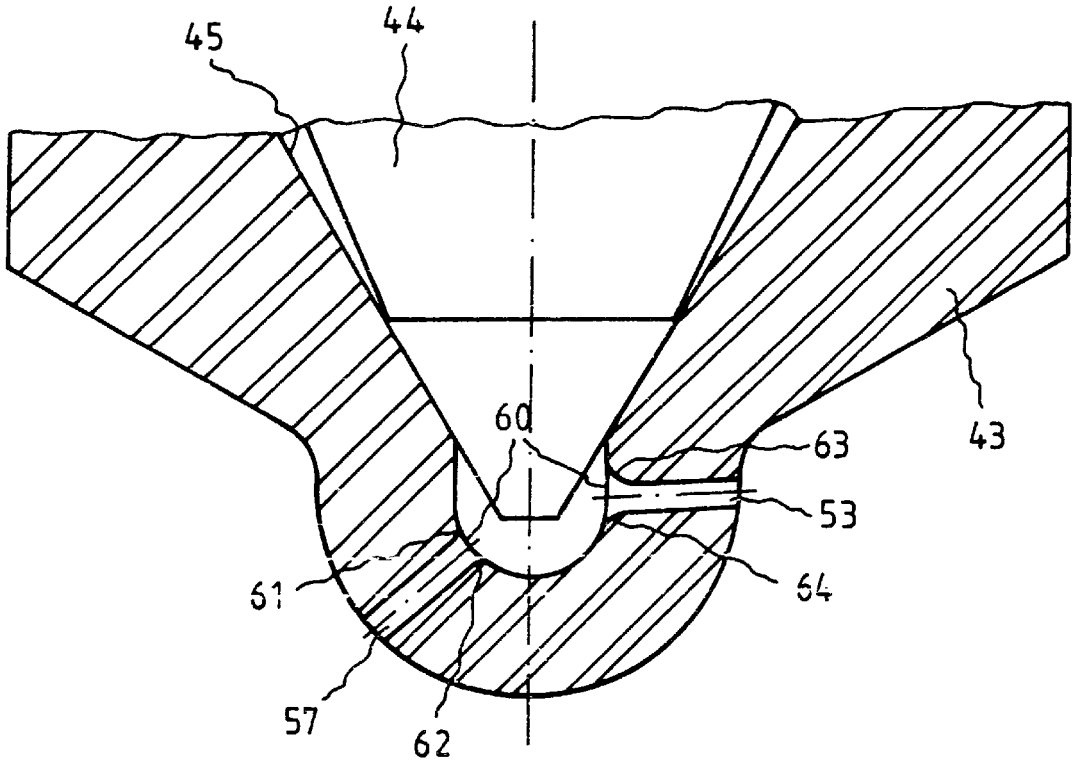
FIG. 1 is a view, partly in section, of the lower region of a fuel injection valve according to the invention.

As shown in FIG. 1, the inlet openings 60 of the injection ports 53, 57 have curved rounded surfaces 61, 62, 63, 64 of different radii, or in other words with different degrees of curved roundness.

For instance, the inlet opening 60 of the injection port 57 has curved rounded surfaces 61, 62 with a lower degree of roundness than the inlet opening 60 of the injection port 53. The degree of curved roundness of the inlet openings of the injection ports, on their side toward the valve member, differ from the degrees of roundness of the inlet openings on their sides remote from the valve member.

In the injection ports 53, 57 shown in FIG. 1, the injection port 53 shown on the right, for instance, whose inlet opening has greater degrees of curved roundness than those of the inlet opening of the injection port 57, is disposed at a point of the engine combustion chamber that is farther away from the combustion chamber wall than that of the injection port 57. That is, by means of the curved rounded surfaces 63, 64 with the greater degrees of roundness, a greater focusing of the fuel stream ejected through the injection port 53 is made possible, and moreover this stream has a greater length than is the case for the fuel stream ejected from the injection port 57.

In other words, the embodiment of the inlet opening 60 of the injection ports 53, 57 is selected as a function of the installed position in the combustion chamber and of the shape of the combustion chamber. In this respect it proves to be particularly advantageous that the curved rounded surfaces 61, 62, 63, 64 are produced in an especially simple way, for instance by so-called HE rounding, or in other words hydroerosive rounding. In this hydroerosive rounding process, a fluid containing grinding bodies is pressed until pressure through previously made bores in the valve body 43, and as a result the edges of the inlet openings are rounded by being ground down. Different degrees of roundness can be produced by covering individual injection ports on their inlet side and/or on their outlet side. Instead of being covered, it is also possible first for only some of the injection ports to be drilled and rounded and only then for the other injection ports to be drilled and rounded. The injection ports drilled and rounded first are then rounded more markedly in an ensuing HE rounding process than the injection ports that were drilled last.

By means of the fuel injection valves described above, an optimal quantitative distribution of the injected fuel can be adapted to the combustion chamber shape and to the installed position, and the shape of the stream is practically freely selectable by varying the degrees of roundness.

The foregoing relates to a preferred exemplary embodiment of the invention, it being understood that other variants and embodiments thereof are possible within the spirit and scope of the invention, the latter being defined by the appended claims.

I claim:

1. A fuel injection valve for internal combustion engines, comprising a valve member (41), which is displaceable in a valve body (43) counter to a restoring force of a valve spring (50) and has a valve sealing face (44), which cooperates with a valve seat (45) disposed on the valve body, a plurality of injection ports, disposed below the valve seat (45) in the valve body (43), said injection ports have inlet openings (60) which are curved rounded, some of the injection ports (53) have at least one degree of curved roundness that is different from the remainder of the injection ports (57).

2. The fuel injection valve according to claim 1, in which the inlet openings (60) of individual injection ports (53, 57) have a different degree of curved roundness, on their side toward the valve member (41), than on their side remote from the valve member (41).

3. The fuel injection valve according to claim 1, in which the degree of curved roundness of the injection ports (53, 57) is adapted to the disposition of the injection ports (53, 57) in the valve body (41), to the installation position in a combustion chamber of the engine, and to the shape of the combustion chamber of the engine.

4. The fuel injection valve according to claim 2, in which the degree of curved roundness of the injection ports (53, 57) is adapted to the disposition of the injection ports (53, 57) in the valve body (41), to the installation position in a combustion chamber of the engine, and to the shape of the combustion chamber of the engine.

5. The fuel injection valve according to claim 3, in which the degree of curved roundness of the inlet opening (60) of the injection port (53) which in the installed state is farther away from a combustion chamber wall, has a higher degree of curved roundness than the inlet opening (60) of an injection port (57) that is not as far away from the combustion chamber wall.

6. The fuel injection valve according to claim 4, in which the degree of curved roundness of the inlet opening (60) of the injection port (53) which in the installed state is farther away from a combustion chamber wall, has a higher degree of curved roundness than the inlet opening (60) of an injection port (57) that is not as far away from the combustion chamber wall.

* * * * *